US005836497A

United States Patent [19]

Pelish

[11] Patent Number: 5,836,497

[45] Date of Patent: Nov. 17, 1998

[54] POUCH FOR A CASINO BUCKET AND METHOD OF MAKING SAME

[76] Inventor: Barbara F. Pelish, 25791 Cunningham, Warren, Mich. 48091-1485

[21] Appl. No.: 689,987

[22] Filed: Aug. 16, 1996

[51] Int. Cl.[6] ..... A45F 3/02; B65D 30/10

[52] U.S. Cl. ..... 224/677; 224/607; 224/625; 224/663; 224/684

[58] Field of Search ..... 224/148.1, 148.4, 224/601, 602, 607, 610, 625, 626, 660, 663, 664, 676, 677, 680–2, 684

[56] References Cited

U.S. PATENT DOCUMENTS

| | | | |
|---|---|---|---|
| D. 371,457 | 7/1996 | Jacobs | 224/626 X |
| 1,439,310 | 12/1922 | Hay et al. | 224/625 X |
| 2,474,495 | 6/1949 | Pollak . | |
| 2,558,382 | 6/1951 | Previdi | 224/682 X |
| 2,592,087 | 4/1952 | Wallace . | |
| 3,158,300 | 11/1964 | Withee . | |
| 3,361,312 | 1/1968 | Hutchison . | |
| 4,079,871 | 3/1978 | Sica . | |
| 4,303,187 | 12/1981 | Berman | 224/684 X |
| 4,444,342 | 4/1984 | Powell . | |
| 4,548,375 | 10/1985 | Moss . | |
| 4,708,273 | 11/1987 | Grant . | |
| 4,747,527 | 5/1988 | Trumpower, II . | |
| 4,893,739 | 1/1990 | Conner . | |
| 4,974,761 | 12/1990 | Luque | 224/235 X |
| 5,158,220 | 10/1992 | Glass | 224/657 |
| 5,181,637 | 1/1993 | Santilli . | |
| 5,240,158 | 8/1993 | Walsh | 224/677 |
| 5,259,541 | 11/1993 | Reese | 224/677 X |
| 5,351,868 | 10/1994 | Beletsky et al. . | |
| 5,386,932 | 2/1995 | Gross . | |
| 5,409,153 | 4/1995 | Ristich . | |
| 5,445,303 | 8/1995 | Cawile, Jr. . | |
| 5,465,889 | 11/1995 | Smith . | |
| 5,568,889 | 10/1996 | Holloway, Jr. et al. | 224/677 X |
| 5,577,653 | 11/1996 | Bieker | 224/684 |

FOREIGN PATENT DOCUMENTS

| | | | |
|---|---|---|---|
| 273737 | 1/1965 | Australia | 383/121 |

*Primary Examiner*—Renee S. Luebke
*Attorney, Agent, or Firm*—Harness, Dickey & Pierce, P.L.C.

[57] ABSTRACT

A pouch specially configured to be worn by a user, and to hold a standard casino bucket in a lower pocket and other items, such as rolled coins, bills, personal effects, etc. in an upper pocket. The lower pocket is cylindrical-like to have a diameter and depth suitable for holding the standard casino bucket, and an elastic band for holding the bucket securely in place. The upper pocket is positioned above the lower pocket and allows access into the upper pocket when the casino bucket is in place. A belt loop or a shoulder strap is provided to secure the pouch to the user.

22 Claims, 4 Drawing Sheets

POUCH FOR A CASINO BUCKET AND METHOD OF MAKING SAME

BACKGROUND OF THE INVENTION

1. Field of the Invention

This invention relates generally to a pouch worn by a person for carrying articles and, more particularly, to a pouch to be secured to a user of the pouch, that includes a cylindrical-shaped lower pocket for holding a casino bucket carrying slot machine coins and an upper pocket for carrying rolled coins, bills, the wearer's personal effects, etc.

2. Discussion of the Related Art

There are many types of purses, pouches, bags, etc. available that are specially configured to hold various types of items, and are equipped with some type of securing device, such as a belt or strap, to attach the bag to a user's body. For example, women generally carry a purse that is equipped with a strap or handle and a closable pouch portion to allow the women to carry her personal effects in the pouch portion and have these effects immediately available if desirable. These types of bags and pouches provide a place to carry and/or confine the different items on the user's body, while at the same time allowing the user to have her hands free for other uses.

The bags and pouches available that can be secured to a person's body to carry different items is extensive. Other types include bags and the like for carrying golf balls and golf accessories, tennis balls, tools, nails, beverage containers, clothespins, etc. These bags come in a variety of different shapes, sizes, and materials, depending on the particular use. Some type of bag or pouch configured to be worn by a person is known to hold almost anything that a person would need to carry to allow the person to have his or her hands free.

One area, not found in the art, where a bag or pouch secured to a person would be beneficial is in a gaming or casino environment. Most casinos provide slot machines where a player of the slot machines will insert one or more coins into the machine, and then activate a spinning mechanism to try to match different symbols in three or more columns in a winning combination. Typically, these slot machines accept coins in dominations such as nickels, dimes, quarters, ½ dollars, dollars, $5.00 dollars or $25.00 dollars.

Persons who play slot machines usually carry a plastic casino bucket decorated with the casino name, that allows the player to more easily carry the coins that he or she is playing with, whether the coins are from a recent winning, and/or are available to subsequently be lost. A player will generally carry the bucket from slot machine to slot machine as he or she plays, and generally will hold the bucket while actually playing the machines. The size of the coins being used, and the quantity of coins the player is playing with at any given time, determines the weight and volume of coins that the player needs to carry. The standard casino bucket has a height of about 5½ inches and a diameter at the open end of about 4½ inches. This standard casino bucket holds approximately five pounds of coins. Because the player may also be carrying other items, such as rolled coins not yet put in the bucket, personal effects, beverages, tobacco products, etc., the casino bucket sometimes become cumbersome to handle and manipulate.

What is needed is a suitable pouch that can be worn by a slot machine player, that is configured to hold a casino bucket carrying coins, as well as other items. It is therefore an object of the present invention to provide such a pouch.

SUMMARY OF THE INVENTION

In accordance with the teachings of the present invention, a pouch is disclosed that is specially configured to be secured to a user, and to hold a standard casino bucket, as well as other items, such as rolled coins, bills, personal effects, etc. The pouch is made from an assembly of pieces of a durable cloth material that are sewn together in a desirable configuration. The pouch includes a cylindrical-shaped lower pocket that has a diameter and depth suitable for holding the standard casino bucket, and has an elastic band for holding the bucket securely in place in the pocket. An upper pocket is provided above the lower pocket and is suitably formed to hold the rolled coins, bills, personal effects, etc. In one embodiment, the pouch includes a belt loop so that the pouch can be secured to the player's belt. Other embodiments include alternate ways of holding the pouch on the player, such as a built-in belt or a shoulder strap.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a pouch for holding a casino bucket and method of making same is merely exemplary in nature, and is in no way intended to limit the invention or its applications or uses.

Figure 1:
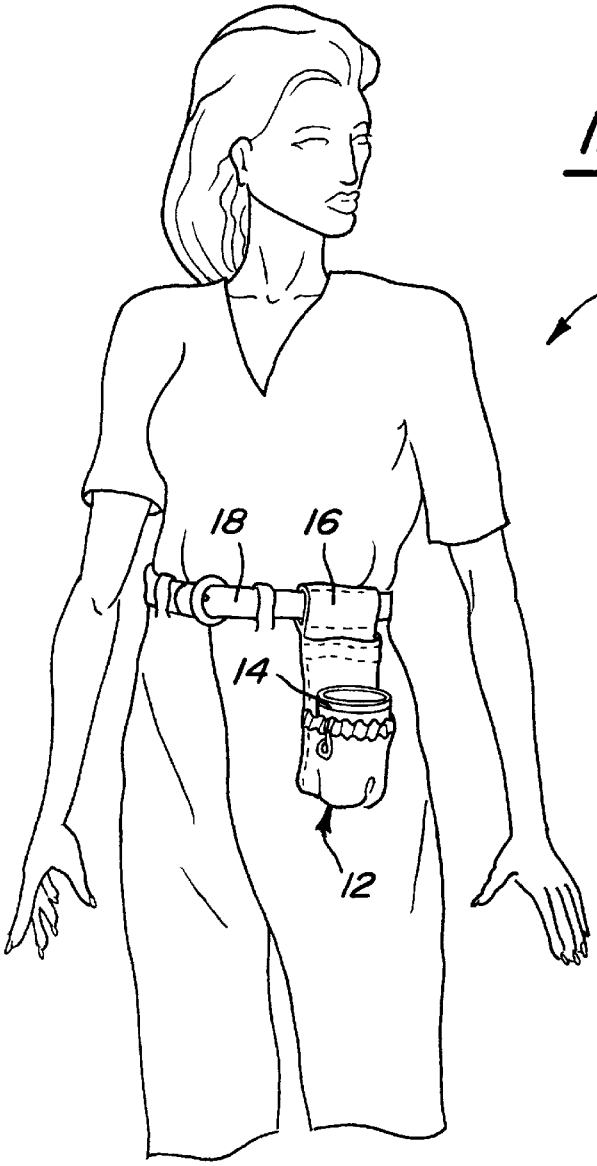
FIG. 1 is an illustration of a person carrying a casino pouch on her belt, according to an embodiment of the present invention.

FIG. 1 illustrates a user 10 of a pouch 12, according to the invention, specially made to hold and secure a standard casino bucket 14 carrying slot machine coins. The pouch 12 includes a built-in belt loop 16, where the user 10 threads her own belt 18 through the belt loop 16 to secure the pouch 12 to her body. In this manner, the pouch 12 is movable to any desirable location around the user's waist to be comfortable for a particular user, where the pouch 12 includes a shape that readily conforms to the user's body.

Figure 2:
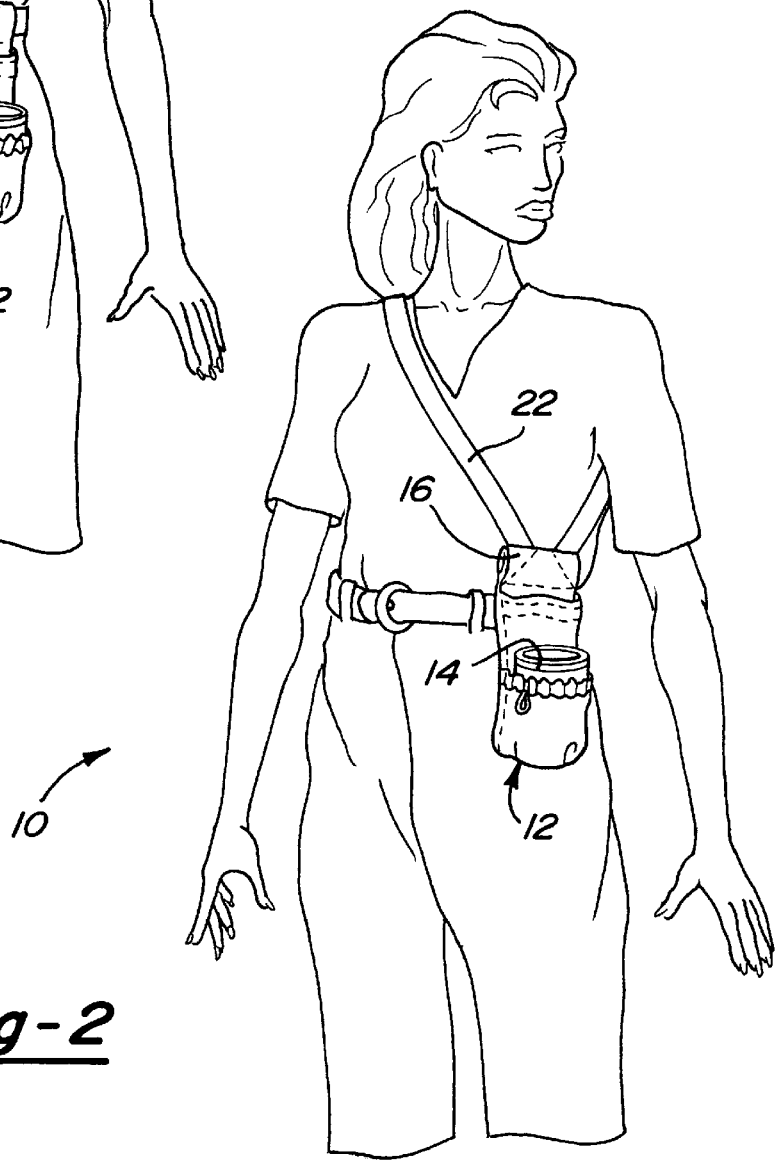
FIG. 2 is an illustration of the person in FIG. 1 carrying the casino belt by a shoulder strap, according to another embodiment of the invention.

In FIG. 2, the pouch 12 includes a shoulder strap 22 so that the user 10 can secure the pouch 12 to her body by slinging the strap 22 over her shoulder to provide an alternate way of holding the pouch 12. In one embodiment, the strap 22 has a width of about two inches. The shoulder strap 22 can be sewn, or attached in some suitable manner, to the pouch 12 to be an integral part of the pouch 12, or can be threaded through the belt loop 16. In this embodiment, the strap 22 is threaded through the belt loop 16, then folded over and stitched to the back of the belt loop 16 so that it extends up from the belt loop 16, as shown. This configuration allows the pouch 12 to more readily conform to the user's body.

Figure 3:
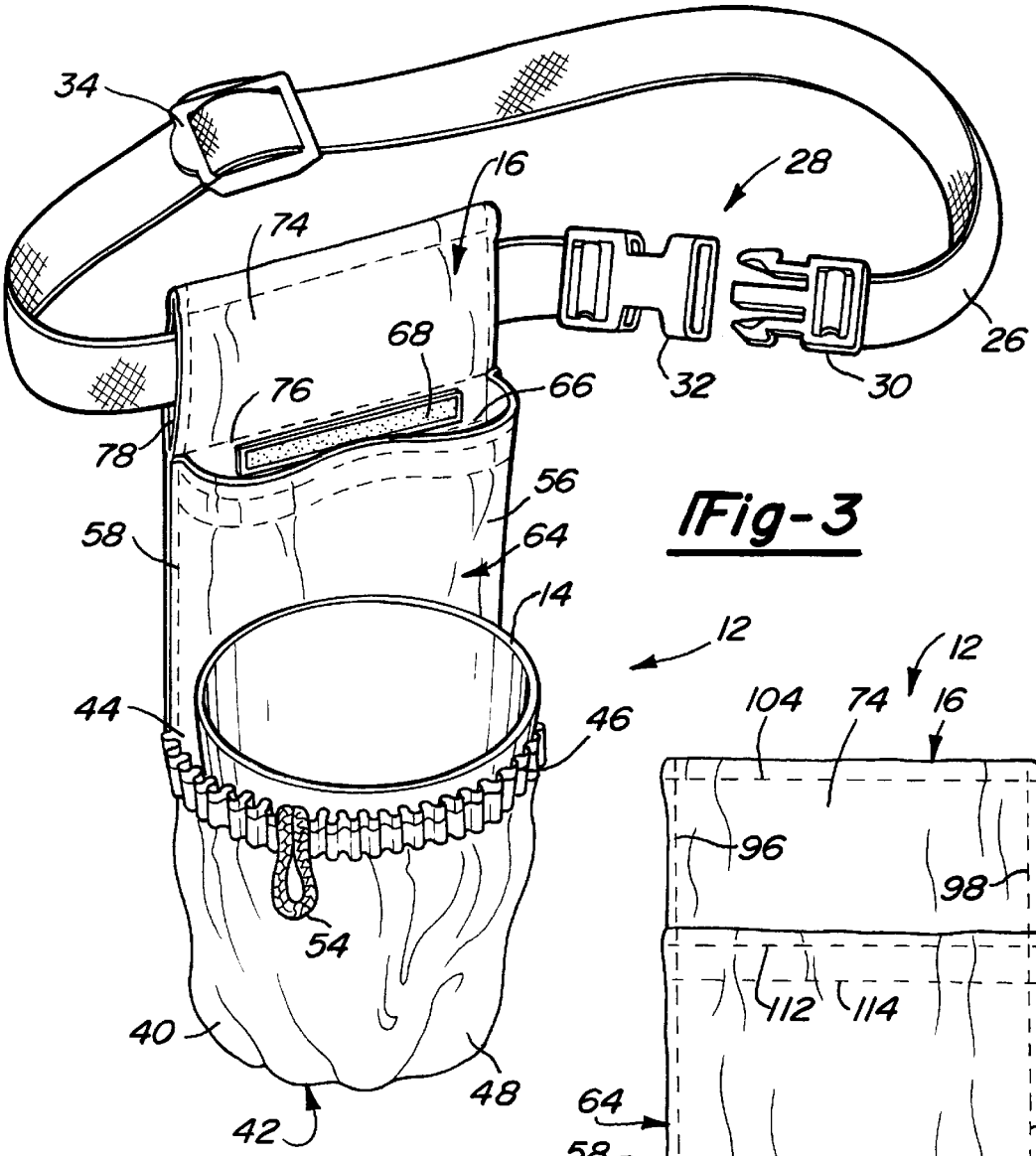
FIG. 3 is a perspective view of the casino pouch shown in FIGS. 1 and 2 separated from the person, and including a belt with an adjustable buckle, according to another embodiment of the present invention.
Figure 4:
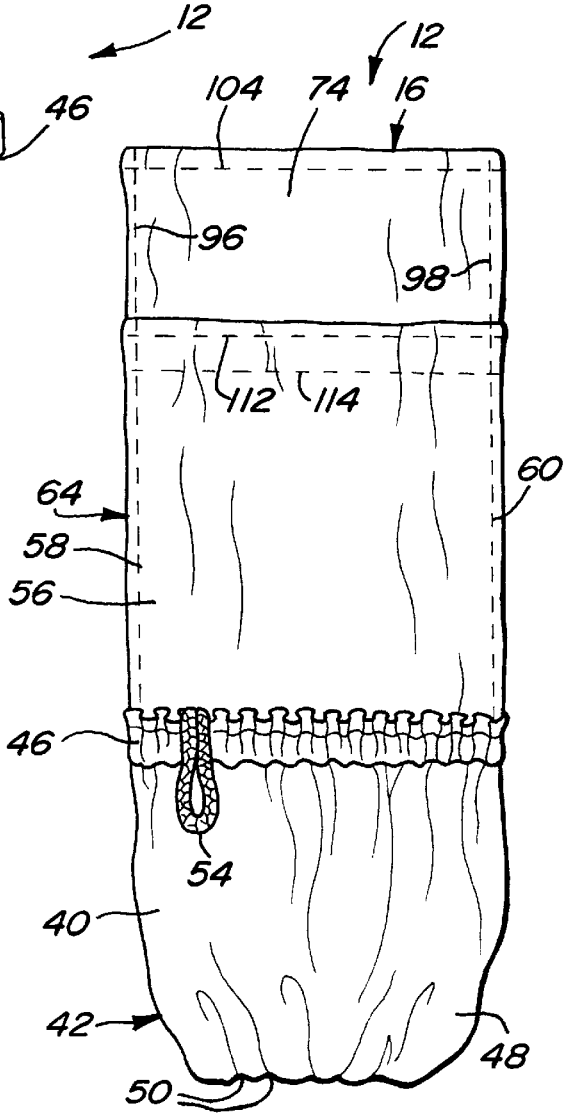
FIG. 4, is a front view of the casino pouch of the invention.
Figure 5:
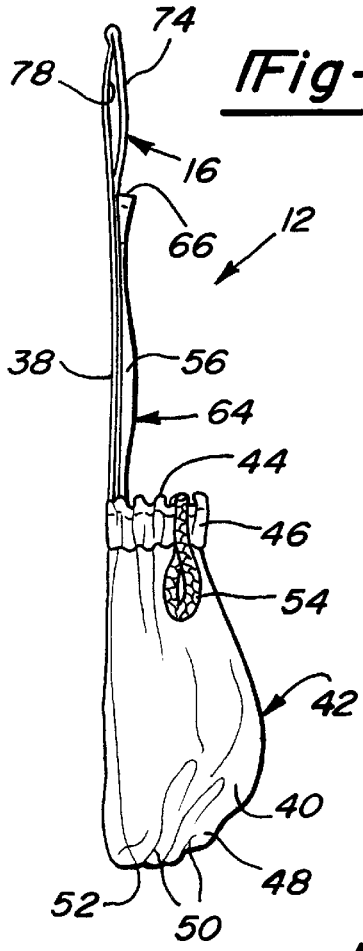
FIG. 5 is a side view of the casino pouch of the invention.
Figure 6:
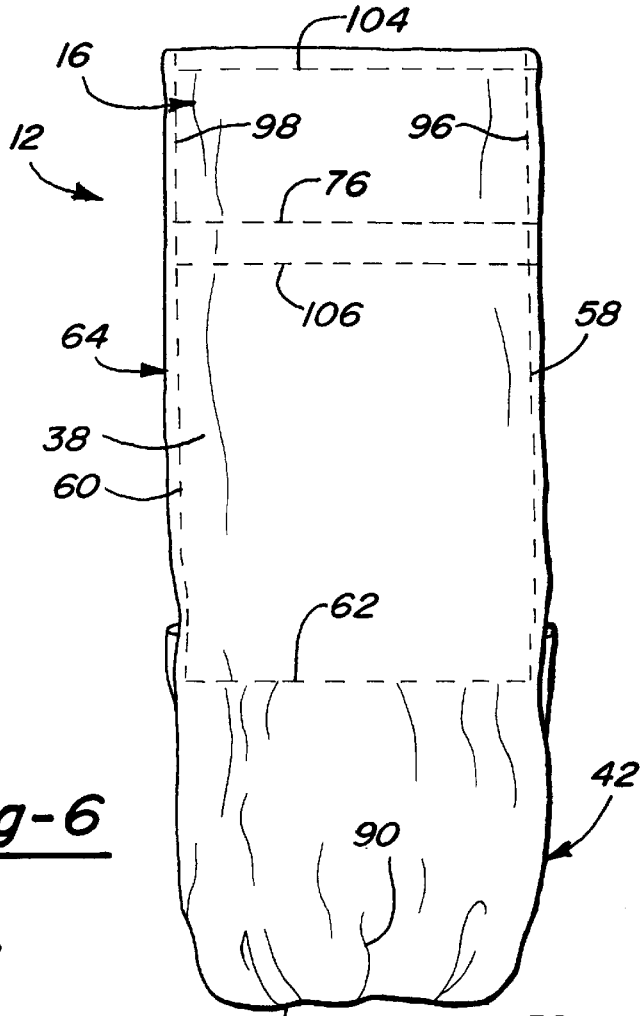
FIG. 6 is a back view of the casino pouch of the invention.
Figure 7:
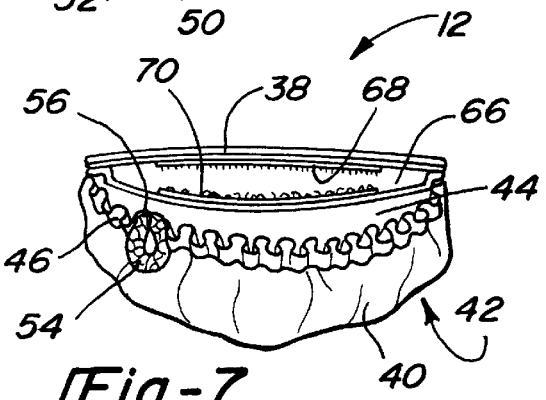
FIG. 7 is a top view of the casino pouch of the invention.
Figure 8:
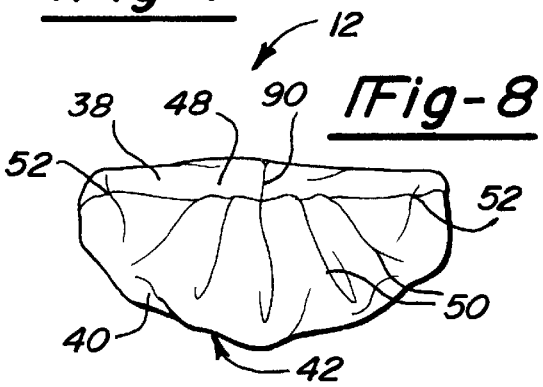
FIG. 8 is a bottom view of the casino pouch of the invention.

FIG. 3 shows a perspective view of the pouch 12, including a belt 26 attached to the belt loop 16. The belt 26 is specially adapted to be part of the pouch 12. The belt 26 includes a clasp 28, having a male connector 30 and a female connector 32, so that the user 10 can secure the pouch 12 around her waist or on her body in some desirable manner. The clasp 28 is positioned proximate to the belt loop 16 so that the user 10 has a good grip on the pouch 12 when she disconnects the clasp 28. A buckle 34 is provided to adjust the length of the belt 26. The discussed embodiments of securing the pouch 12 to the user 10 are by way of non-limiting examples in that the pouch 12 can be secured to the user 10 in any suitable manner.

In one embodiment, the pouch 12 is an assembly of several different pieces of material assembled and sewn together, in a manner that will be described below, to provide the desirable configuration. Preferably, the material is KIDIT a leather-like, synthetic fabric, that has a tight weave strong enough to stand up to the rigors and weight requirements for the intended purpose, and is lightweight and washable. KIDIT has an outside surface having a leather texture and appearance, and an inside surface having a brushed, unfinished texture and appearance. Of course, this material is one example of a suitable fabric, and as will be appreciated by those skilled in the art, other fabrics, such as real leather, may also be suitable.

FIGS. 4–8 show various views of the pouch 12 without the casino bucket 14, and separated from the user 10. The pouch 12 includes a back panel 38, where an outside surface of the back panel 38 faces the user 10. A lower pocket panel 40 is sewn to the back panel 38 to combine to define a cylindrical or cup-like lower pocket 42 having a semi-circular shaped open area 44 encircled by a sewn in elastic band 46. The open area 44 is suitably configured to accept the bucket 14. An outside surface of the pocket panel 40 faces away from the user 10. A closed bottom portion 48 of the lower pocket 42 opposite to the open area 44 is specially sewn to include a series of darts 50 and corners 52 to provide a substantially flat bottom surface configured to accept and position the casino bucket 14 within the pocket 42 in a stable manner. In order to accommodate the casino bucket 14, in one embodiment, the lower pocket 42 has a height of about eight inches, and a diameter of about six inches. However, the lower pocket 42 can take on other dimensions if desirable. A loop 54 is stitched to a desirable location on the elastic band 46 to provide a mechanism for securing clippable items, such as key chains, promotion cards, etc.

An upper pocket panel 56 is sewn to the back panel 38 along seams 58, 60 and 62 to combine to form an upper pocket 64 having an open upper end 66. An outside surface of the upper pocket panel 56 faces away from the user 10. The upper pocket panel 56 is big enough to allow a person to easily insert her hand through the open end 66 of the upper pocket 64, and is wide and deep enough to hold a few standard rolls of coins. In one embodiment, the upper pocket 64 is rectangularly shaped having a width of about 5½ inches, a height of about 7 inches and a depth of about 1 inch. This allows six rolls of dimes, five rolls of nickels, four rolls of quarters or three rolls of dollars, or any suitable combination thereof, to be held in the upper pocket 64.

A hook strip 68 is sewn to an inside surface of the back panel 38, and a loop strip 70 is sewn to an inside surface of the upper pocket panel 56 directly across from the hook strip 68. Of course, the hook strip 68 and the loop strip 70 can be reversed. The hook strip 68 and the loop strip 70 provide a suitable closure mechanism for the upper pocket 64 so that it is easily and readily opened, and can be opened and closed many times without wearing out.

The belt loop 16 is formed by forming a belt loop panel 74 with the back panel 38 by folding the back panel 38 and stitching along seam 76 to form an opening 78 across the width of the pouch 12.

Figure 9:
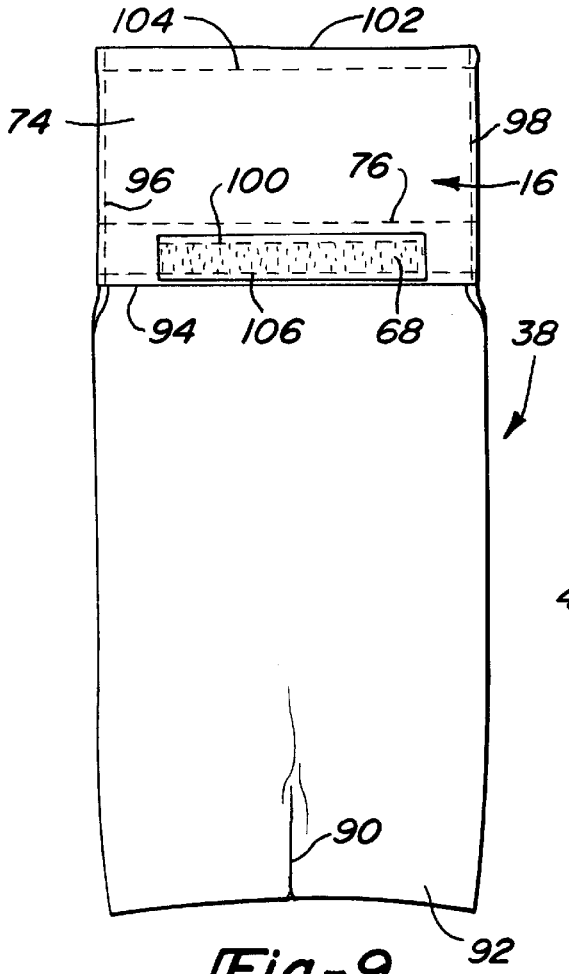
FIG. 9 is a back panel of the casino pouch of the invention during an assembly step of the pouch.

As mentioned above, the pouch 12 is an assembly of several pieces of Kidit fabric assembled, sewn and stitched together into a desirable configuration. The following discussion describes the process of assembling and stitching the different panels together to make the pouch 12, according to the invention. First, cut a piece of fabric for the back panel 38, as shown in FIG. 9, to a width of about six inches and a length of about sixteen inches. At a bottom center location of the back panel 38, gather an overlapping section of the outside surface of the panel 38 approximately 1½ inches deep and two inches high, and stitch the gathered section to form a dart 90. Cut off the excess fabric behind the stitch. This procedure narrows a bottom portion 92 of the back panel 38, forming a cupping effect that will eventually be part of the bottom portion 48 of the lower pocket 42.

Next, measure about 6½ inches from an opposite edge 94 of the back panel 38, and mark a line across the width of the panel 38 at this location on the inside surface of the panel 38. Turn in both side edges of the panel 38 about ¼ of an inch towards the inside surface, and sew stitchings 96 and 98 to make folded edges. Cut the hook strip 68 to about 3½ inches long, and sew in stitch 100 to secure the strip 68 to the back panel 38. Next, fold the back panel 38 towards the inside surface such that the edge 94 aligns with the line marked 6½ inches from the edge 94 to form the panel 74 and a folded edge 102. Sew a stitch 104 about ¼ of an inch from the folded edge 102. Sew the stitch 76 about two inches below the stitch 104, just above the hook strip 68. The combination of the stitches 104 and 76 form the belt loop 16. Then, sew in a stitch 106 about one inch below the stitch 76 across the hook strip 68. Measure about six inches down from the stitch 76, and mark a line across the width of the inside surface of the back panel 38.

Figure 10:
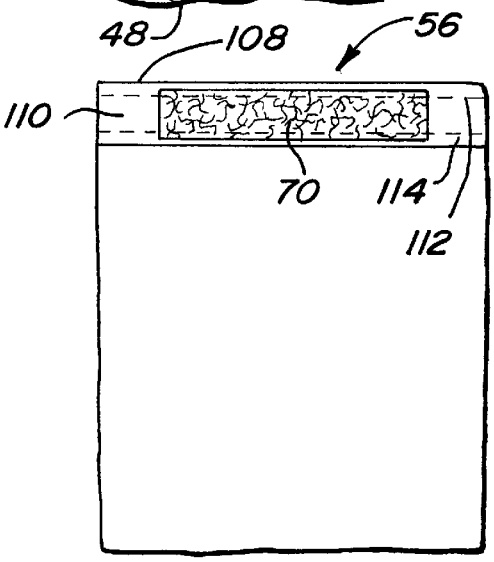
FIG. 10 is an upper pocket panel of the casino pouch of the invention during an assembly step of the pouch.

For the upper pocket panel 56, cut a piece of the Kidit fabric about eight inches by seven inches. Fold an outside edge of the upper pocket panel 56 over the inside surface to form a folded edge 108 and about a one inch folded strip section 110, as shown in FIG. 10. Center the loop strip 70 on the folded section 110, and sew stitches 112 and 114 through the loop strip 70 across the folded section 110, as shown. The stitch 112 is approximately ¼ inch from the folded edge 108, and the stitch 114 is approximately ½ inch below the stitch 112.

Figure 11:
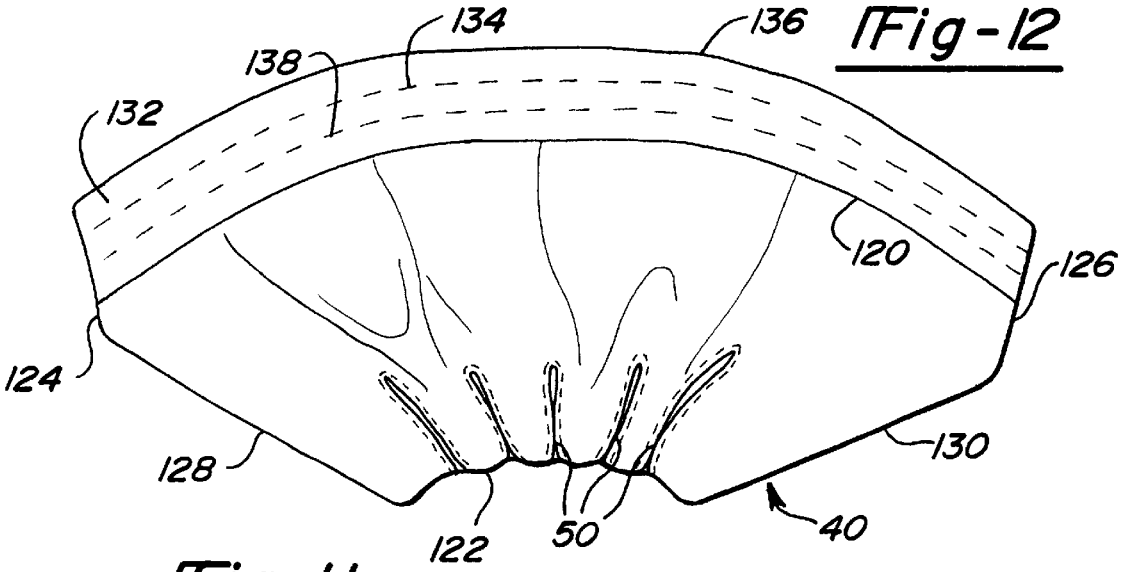
FIG. 11 is a lower pocket panel of the casino pouch of the invention during an assembly step of the pouch.

To form the lower pocket 42, first cut an eight inch by fifteen inch piece of the Kidit fabric to make the lower pocket panel 40. As shown in FIG. 11, cut the lower pocket panel 40 such that a top edge 120 is about fifteen inches long, a bottom edge 122 is about 10½ inches long, first and second side edges 124 and 126 are about three inches long, and first and second angled side edges 128 and 130 are about 5½ inches long. To form the darts 50, make a mark along the bottom edge 122 of the pocket panel 40 at 2", 3¼", 5½", 6¾", and 8" locations from one side. The marks at the two inch and eight inch positions are 2½ inches high from the edge 122 and the other marks are 1½ inches high from the edge 122. At each marked dart location, gather the outside surface of the fabric to a depth of about ⅝ of an inch, and stitch the gathered fabric to form the darts 50 narrowing to the top of the marks. Cut the excess fabric off behind the stitches. Therefore, the first and fifth darts are about 2½ inches high, and the second, third and fourth darts are about 1½ inches high from the edge 122. The gathered fabric defining the darts 50 form a cup shape to the bottom of the lower pocket panel 40 that will eventually become part of the bottom portion 48 of the pocket 42.

The top edge 120 of the lower pocket panel 40 is folded onto the inside surface of the panel 40 to form a 1½ inch folded section 132. A stitch 134 is sewn ¼ of an inch from a top folded edge 136, and a stitch 138 is sewn about one inch below the stitch 134. A ⅝ inch wide, seven inch length of no-roll elastic strip is cut and worked into the folded section 132 between the stitches 134 and 138. The ends of the elastic are stitched to secure the elastic band 46 in place.

Figure 12:
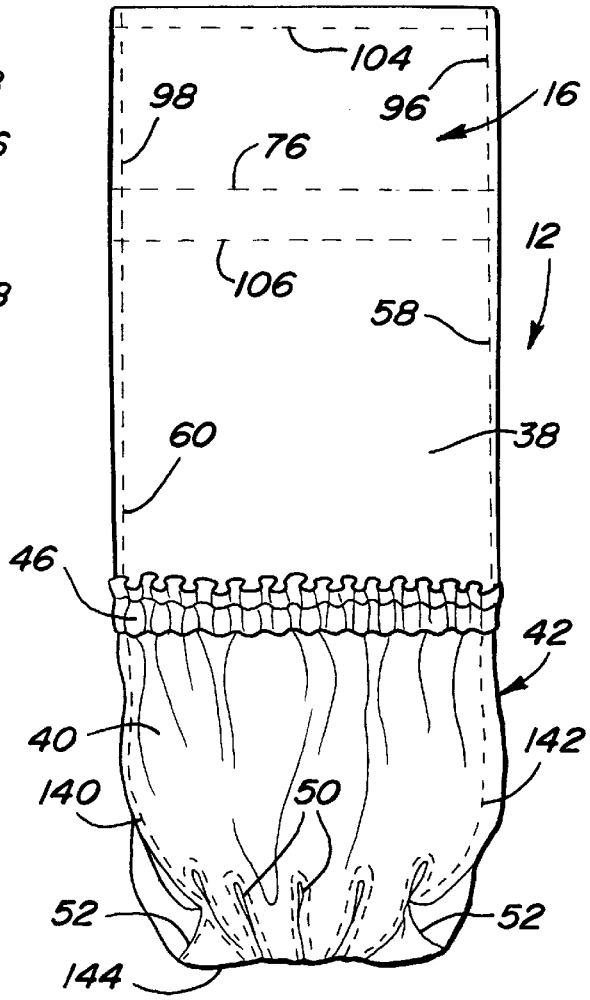
FIG. 12 is a partially assembled view of the casino pouch of the invention.

To assemble the lower pocket panel 40 to the back panel 38, the outside surface of the back panel 38 is aligned with the outside surface of the lower pocket panel 40 so that the darts 50 are centered relative to the dart 90, as shown in FIG. 12. In this view, the pocket 42 is inside out. Then, both side edges where the back panel 38 and the lower pocket panel 40 connect are double stitched at seams 140 and 142. A bottom edge is also stitched at seam 144. With the lower pocket 42 still inside out, square ends are gathered and stitched approximately one inch long to form the corners 52, and the excess fabric is cut off.

The lower pocket 42 is then turned outside out, and the upper pocket panel 56 is attached to the back panel 38, by first aligning the hook strip 68 with the loop strip 70. A lower edge of the upper pocket panel 56 is folded about ½ inches from the bottom and aligned with the line formed six inches down from the stitch 76. The upper pocket panel 56 is secured to the back panel 38 by stitching along this line to form stitch 62, and along both seams 58 and 60. The loop 54 is then stitched to the band 46.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A pouch to be secured to a user and for carrying various items, said pouch comprising:

a back panel;

a lower pocket formed by the back panel and a lower pocket panel, said lower pocket including an open upper portion and a substantially flat closed base portion combining to define a cup-like shape configured to accept and hold a cylindrical-shaped bucket, said closed base portion being formed by a combination of a portion of the back panel and a portion of the lower pocket panel, wherein the part of the closed base portion formed by the portion of the back panel includes at least one sewn back panel dart and the part of the closed base portion formed by the portion of the lower pocket panel includes at least one sewn lower pocket panel dart, and wherein the at least one back panel dart is formed by gathering a dart portion of the back panel and stitching the gathered dart portion of the back panel and the at least one lower pocket panel dart is formed by gathering a dart portion of the lower pocket panel and stitching the gathered dart portion of the lower pocket panel, said lower pocket panel being stitched to the back panel on an inside of the lower pocket so that the stitching is not visible from an outside of the lower pocket; and an upper pocket defined by the back panel and an upper pocket panel, said upper pocket being positioned above the lower pocket and allowing access into the upper pocket when the bucket is in the lower pocket.

2. The pouch according to claim 1 wherein the closed base portion of the lower pocket includes one back panel dart and five lower pocket panel darts where each dart is formed by gathering a dart portion of the panel and stitching the gathered dart portion, and wherein a seam formed by sewing the back panel to the lower pocket panel extends between the back panel dart and the five lower pocket panel darts.

3. The pouch according to claim 1 wherein a top edge of the lower pocket includes an elastic band positioned to hold the bucket in the lower pocket.

4. The pouch according to claim 1 further comprising a belt loop positioned above the upper pocket, said belt loop configured to be secured on a belt of the user.

5. The pouch according to claim 1 further comprising a strap, said strap being configured to allow the pouch to be worn over a shoulder of the user.

6. The pouch according to claim 5 wherein the strap extends through a belt loop formed in the pouch above the upper pocket, said strap being folded behind the belt loop and stitched to a back of the belt loop in a manner so that it extends up from the belt loop.

7. The pouch according to claim 1 wherein the upper pocket includes a loop strip and a hook strip for closing the upper pocket in a secure manner.

8. The pouch according to claim 1 wherein the lower pocket is configured to carry a casino bucket, said lower pocket having a height of about eight inches and a diameter of about six inches.

9. The pouch according to claim 1 wherein the upper pocket is configured to carry rolled coins, said upper pocket being rectangularly-shaped having a width of about 5½ inches, a height of about 7 inches and a depth of about 1 inch.

10. The pouch according to claim 1 wherein the closed base portion of the lower pocket includes a first stitched corner at one side of the base portion and a second stitched corner at an opposite side of the base portion, said first and second stitched corners being formed by gathering a portion of the back panel and the lower pocket panel and stitching the gathered portion of the back panel and the lower pocket panel, said stitched corners combining with the at least one sewn back panel dart and the at least one sewn lower pocket panel dart to give the base portion its substantially flat configuration.

11. A pouch for carrying a casino bucket and adapted to be secured to a user of the pouch, said pouch comprising:

a back panel made of a fabric material;

a lower pocket formed by the back panel and a lower pocket panel and made of a fabric material, said lower pocket panel being stitched to said back panel, said lower pocket including an open upper portion and a substantially flat closed base portion combining to define a cup-like shape configured to accept and hold the casino bucket, said lower pocket further including an elastic band secured around a top edge of the lower pocket and acting to hold the casino bucket in the lower pocket, said closed base portion being formed by a combination of a portion of the back panel and a portion of the lower pocket panel, wherein the part of the closed base portion formed by the portion of the back panel includes at least one sewn back panel dart and the part of the closed base portion formed by the portion of the lower pocket panel includes at least one sewn lower pocket panel dart, wherein the at least one back panel dart is formed by gathering a dart portion of the back panel and stitching the gathered dart portion of the back panel and the at least one lower pocket panel dart is formed by gathering a dart portion of the lower pocket panel and stitching the gathered dart portion of the lower pocket panel, and wherein the lower pocket panel is stitched to the back panel on an inside of the lower pocket so that the stitching is not visible from an outside of the lower pocket;

an upper pocket formed by the back panel and an upper pocket panel and made of a fabric material, said upper pocket panel being stitched to said back panel above the lower pocket panel, wherein a lower edge of the upper pocket is adjacent to the upper portion of the lower pocket, and wherein the user can gain access to the upper pocket when the casino bucket is in the lower pocket, said upper pocket including means for holding the upper pocket closed; and means for securing the pouch to the body of the user.

12. The pouch according to claim 11 wherein the means for securing includes a belt loop formed in the back panel above the upper pocket panel.

13. The pouch according to claim 11 wherein the means for securing includes a strap secured to the back panel above the upper pocket panel.

14. The pouch according to claim 11 wherein the means for holding the upper pocket closed is a loop strip and a hook strip secured to the upper pocket panel and the back panel.

15. The pouch according to claim 11 wherein the lower pocket has a height of about eight inches and a diameter of about six inches.

16. The pouch according to claim 11 wherein the upper pocket is configured to carry rolled coins, and has a rectangular-shape having a width of about 5½ inches, a height of about 7 inches and a depth of about 1 inch.

17. The pouch according to claim 11 wherein the closed base portion of the lower pocket includes one back panel dart and five lower pocket panel darts where each dart is formed by gathering a dart portion of the panel and stitching the gathered dart portion, and wherein a seam formed by sewing the back panel to the lower pocket panel extends between the back panel dart and the five lower pocket panel darts.

18. The pouch according to claim 11 wherein the closed base portion of the lower pocket includes a first stitched corner at one side of the base portion and a second stitched corner at an opposite side of the base portion, said first and second stitched corners being formed by gathering a portion of the back panel and the lower pocket panel and stitching the gathered portion of the back panel and the lower pocket panel, said stitched comers combining with the at least one sewn back panel dart and the at least one sewn lower pocket panel dart to give the base portion its substantially flat configuration.

19. A method of making a pouch for carrying various items, said method comprising the steps of:

providing a first piece of fabric;

gathering and stitching a piece of the fabric at a first end of the first piece of fabric to form at least one dart and give the first end of the first piece of fabric a cup-like shape;

providing a second piece of fabric;

gathering and stitching a plurality of pieces of the fabric at a first end of the second piece of fabric to form a plurality of darts to give the first end of the second piece of fabric a cup-like shape;

stitching the first piece of fabric to the second piece of fabric so that the cup-like end of the first piece of fabric and the cup-like end of the second piece of fabric are joined to provide a closed lower end of a first pocket having a substantially flat configuration;

providing a third piece of fabric; and stitching the third piece of fabric to the first piece of fabric above the first pocket to define a second pocket above the first pocket, wherein the third piece of fabric is stitched to the first piece of fabric in such a manner that the second pocket has an open upper end opposite to the first pocket.

20. The method according to claim 19 further comprising the steps of folding a second end of the first piece of fabric opposite to the lower pocket to form a folded portion and stitching the folded portion to define a belt loop.

21. The method according to claim 19 further comprising the step of stitching an elastic band to a second end of the second piece of fabric such that the first pocket has an elastic band around an opening of the first pocket opposite to the closed end.

22. The method according to claim 19 further comprising the step of stitching a closing device to the first piece of fabric and the third piece of fabric to close the second pocket.

* * * * *

UNITED STATES PATENT AND TRADEMARK OFFICE

CERTIFICATE OF CORRECTION

PATENT NO. : 5,836,497

DATED : November 17, 1998

INVENTOR(S) : Barbara F. Pelish

It is certified that error appears in the above-identified patent and that said Letters Patent is hereby corrected as shown below:

Column 8, line 11, "comers" should be --corners--.

Signed and Sealed this

Twenty-seventh Day of April, 1999

*Attest:*

Q. TODD DICKINSON

*Attesting Officer*

*Acting Commissioner of Patents and Trademarks*